US006338670B1

(12) United States Patent
Okumura et al.

(10) Patent No.: US 6,338,670 B1
(45) Date of Patent: Jan. 15, 2002

(54) METHOD AND SYSTEM OF MANUFACTURING SLURRY FOR POLISHING, AND METHOD AND SYSTEM OF MANUFACTURING SEMICONDUCTOR DEVICES

(75) Inventors: Katsuya Okumura, Yokohama; Yoshinori Yoshida, Tokyo, both of (JP)

(73) Assignees: Kabushiki Kaisha Toshiba, Kawasaki; JSR Corporation, Tokyo, both of (JP)

( * ) Notice: Subject to any disclaimer, the term of this patent is extended or adjusted under 35 U.S.C. 154(b) by 0 days.

(21) Appl. No.: 09/527,804

(22) Filed: Mar. 17, 2000

(30) Foreign Application Priority Data

Mar. 18, 1999 (JP) ..... 11-074628

(51) Int. Cl.[7] ..... B24B 1/00
(52) U.S. Cl. ..... 451/60; 451/446
(58) Field of Search ..... 451/36, 41, 59, 451/60, 54, 446

(56) References Cited

U.S. PATENT DOCUMENTS 5,781,970 A 8/1998 Yueh
5,957,759 A * 9/1999 Cardenas et al. ..... 451/60
6,123,602 A * 9/2000 Rodriguez et al. ..... 451/5
6,165,048 A * 12/2000 Russ et al. ..... 451/5

FOREIGN PATENT DOCUMENTS

EP 0 899 005 3/1999
WO 96/02319 1/1996

* cited by examiner

*Primary Examiner*—Timothy V. Eley
*Assistant Examiner*—Dung Van Nguyen
(74) *Attorney, Agent, or Firm*—Oblon, Spivak, McClelland, Maier & Neustadt, P.C.

(57) ABSTRACT

A manufacturing system of semiconductor devices, which comprises a dispersing equipment for dispersing inorganic oxide with water, a filtrating equipment provided behind the dispersing equipment for filtrating the slurry sent from the dispersing equipment, a supplying equipment provided behind the filtrating equipment for supplying the slurry sent from the filtrating equipment to a CMP polishing equipment, and the CMP polishing equipment provided behind the supplying equipment for polishing semiconductor devices by using the slurry supplied from the supplying equipment.

According to the present invention, it is possible to supply slurry to the CMP polishing equipment at the right time in the right quantity. Accordingly, it is possible to eliminate the cost incurred by performing the strict quality control of the slurry during the storage.

4 Claims, 6 Drawing Sheets

METHOD AND SYSTEM OF MANUFACTURING SLURRY FOR POLISHING, AND METHOD AND SYSTEM OF MANUFACTURING SEMICONDUCTOR DEVICES

FIELD OF THE INVENTION

The present invention relates to a method of preparing slurry from inorganic oxide and water and supplying the prepared slurry to polishing equipment and also relates to a system which realizes this method. Furthermore, the present invention relates to a method of preparing slurry from inorganic oxide and water and supplying the prepared slurry to polishing equipment for manufacturing semiconductor devices and also relates to a system which realizes this method.

BACKGROUND OF THE INVENTION

Recently, slurry obtained by dispersing vapor-phase processed inorganic oxide particles in water has been used for polishing semiconductor devices, such as VLSI. This slurry is prepared to the desired composition, the desired concentration, the desired purity, etc., packed in a drum or other transport container, and shipped out to manufacturers who manufacture and polish semiconductor devices.

However, the method of packing the slurry for polishing in a drum or other transport container and shipped the same to manufacturers who manufacture and polish semiconductor devices has the following four problems (a) though (d):

(a) The slurry may dry or inorganic particles in the slurry may flocculate or precipitate during the transport or storage. As a result, the concentration and purity of the slurry or the particle size of the inorganic particles in the slurry may differ from those immediately after the preparation, and the desired polishing characteristics may not be obtained. In order to avoid this problem, it is necessary to thoroughly perform the quality control of the slurry during the transport and storage, or alternatively have the manufacturers who manufacture and polish semiconductor devices redo the filtration, refining and analysis of the slurry to reconfirm the quality of the slurry. However, it takes both the slurry manufacturers and the manufacturers who manufacture and polish semiconductor devices very high cost to perform this procedure.

(b) The desired polishing characteristics depend on the type, etc. of the semiconductor devices, etc. to be polished. For this reason, it is necessary to determine the composition, concentration, purity, pH, etc. of the slurry according to the object to be polished. However, it takes the slurry manufacturers very high cost to manufacture the slurry to the composition, concentration, purity, pH, etc. specified by the manufacturers who manufacture and polish semiconductor devices in their orders and supply the same to the manufacturers who manufacture and polish semiconductor devices on the other hand, a method of supplying the slurry prepared to the specified polishing characteristics (compositions, concentrations, purities, pHs, etc.) to the manufacturers who manufacture and polish semiconductor devices for their stock has a problem that the storage period may be longer and the above-described problem (a) may occur.

(c) The slurry which is low in stability is subject to quality deterioration during the storage or transport. Therefore, even if the polishing characteristics of the slurry has high polishing performance immediately after the manufacture, the quality of the slurry may deteriorate during the storage or transport, the polishing performance of the slurry may also deteriorate, and as a result, the slurry may no longer applicable to any industrial uses.

(d) Generally, the slurry for polishing is so low in concentration as 5 to 30%. This makes the slurry bulky and increases the transport cost.

SUMMARY OF THE INVENTION

In view of the problems described above, an object of the present invention is to eliminate the cost incurred by performing the strict quality control of the slurry during the transport or storage. Another object of the present invention is to make it possible to supply the slurry to the manufacturing system which manufactures and polishes semiconductor devices at the right time in the right quantity. Still another object of the present invention is to make it possible to make the instable slurry applicable to industrial uses. Still another object of the present invention is to prevent the slurry for polishing from deteriorating the cleanliness of the manufacturing system for semiconductor devices.

The method of manufacturing the slurry for polishing according to the present invention sequentially performs a process for dispersing inorganic oxide in water to obtain the slurry, a process for filtrating the obtained slurry, and a process for supplying the filtrated slurry to polishing equipment.

The method of manufacturing semiconductor devices according to the present invention sequentially performs a process for polishing semiconductor devices by using the supplied slurry following the supply process described above, and a process for detecting the polished condition of the polished semiconductor devices.

The system of manufacturing the slurry for polishing according to the present invention comprises a dispersing equipment for dispersing inorganic oxide in water to obtain the slurry by kneading the inorganic oxide with the water, a filtrating equipment provided behind the dispersing equipment for filtrating the slurry sent from the dispersing equipment, and a supplying equipment provided behind the filtrating equipment for supplying the slurry sent from the filtrating equipment to the polishing equipment.

The manufacturing system for semiconductor devices according to the present invention has polishing equipment provided behind the supplying equipment described above for polishing semiconductor devices by using the slurry continuously supplied from the supplying equipment described above.

Among the inorganic oxides which can be used in the present invention are metal oxide, such as silicon oxide, aluminum oxide, titanic oxide, zirconium oxide, antimony oxide, chromium oxide, germanium oxide, vanadium oxide, tungsten oxide, iron oxide, cerium oxide, manganese oxide and zinc oxide. Of these metal oxides, silicon oxide, aluminum oxide, titanic oxide and cerium oxide are particularly preferable. As the inorganic oxide used in the present invention, the inorganic oxide synthesized by the vapor-phase process, such as the fumed process for synthesizing silica by allowing silicon tetrachloride to react with hydrogen and oxygen and then hydrolyzed (high-temperature flame hydrolysis process) or the Nano-phase Technology's process for synthesizing inorganic oxides particles by heating a metal to a temperature above the melting point of such metal to produce metal vapor and allowing such metal vapor to react with oxygen (metal evaporation and oxidation process), is preferable for its high purity. Alternatively, as the inorganic oxide used in the present invention, the inorganic oxide synthesized by the sol-gel process for synthesizing inorganic oxides by hydrolyzing metallic alkoxide may be used. The inorganic oxide synthesized by the fumed process is more preferable as such inorganic oxide is high in purity and also comparatively inexpensive. On the other hand, more than one type of inorganic oxide may be used in the mixed status.

DETAILED DESCRIPTION OF THE INVENTION

The present invention will be described in details as follows:

(1) System Configuration

Figure 1:
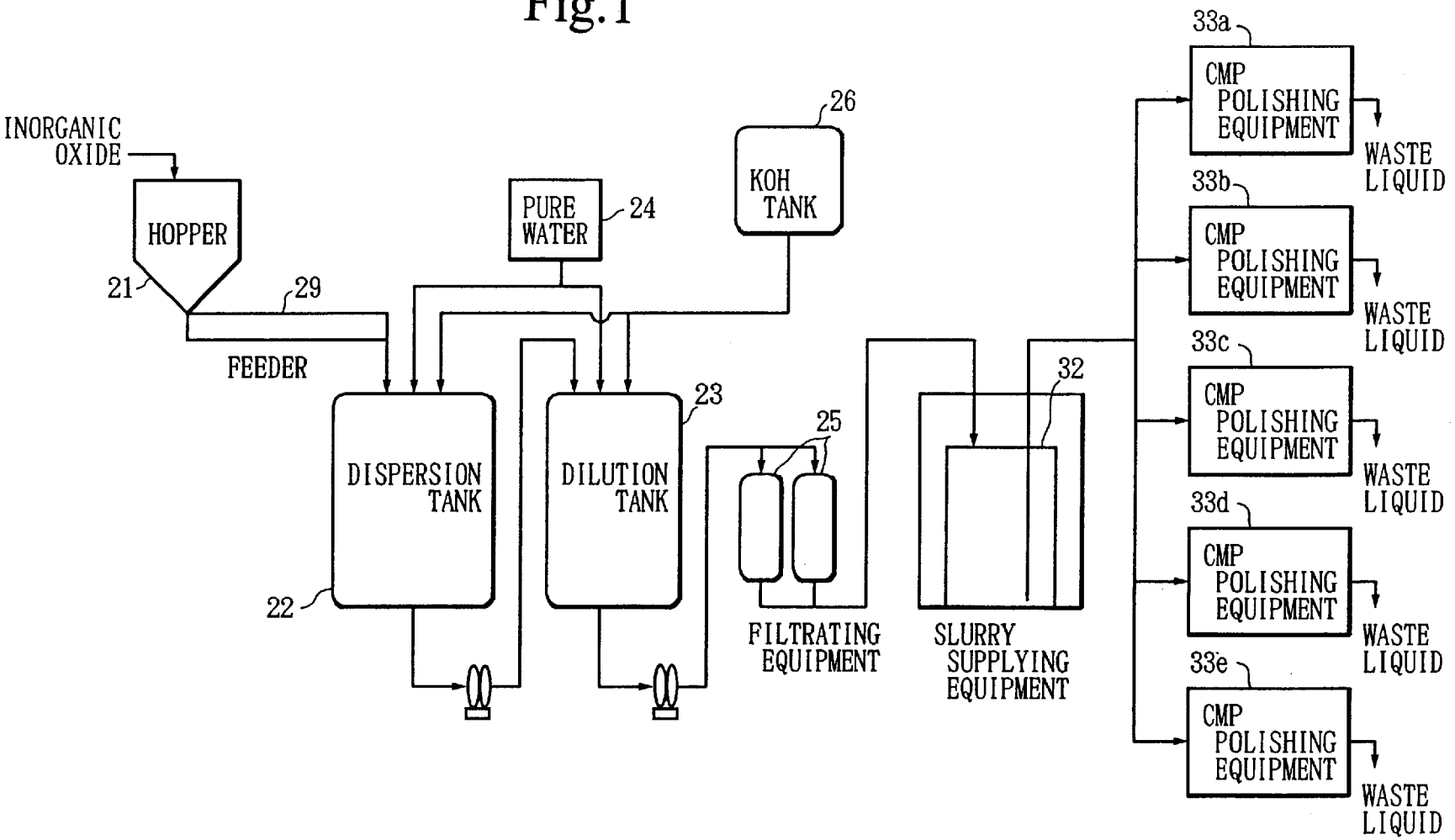
FIG. 1 is a schematic view illustrating the entire construction of a system according to the present invention.

FIG. 1 shows an example of the configuration of the manufacturing system according to the present invention.

The system shown in this figure has a dispersing equipment for manufacturing the slurry of inorganic particle by kneading inorganic oxide with water, a filtrating equipment provided behind the dispersing equipment in connection thereto for filtrating the slurry of inorganic particle sent from the dispersing equipment, a supplying equipment provided behind the filtrating equipment in connection thereto for supplying the slurry of inorganic particle sent from the filtrating equipment to a polishing equipment, and the polishing equipment provided behind the supplying equipment in connection thereto for polishing semiconductor devices by using the slurry supplied from the supplying equipment.

The dispersing equipment has a hopper 21, a feeder 29, a dispersion tank 22 and a dilution tank 23. In the hopper 21 is supplied inorganic oxide as raw material. The feeder 29 transfers the raw material supplied from the hopper 21 to the dispersion tank 22 and thereby supplies the same to the dispersion tank 22. The dispersion tank 22 mixes the raw material supplied from the feeder 29 with pure water supplied from a pure water tank 24 and thereby manufactures the slurry of inorganic particle. The dilution tank 23 dilutes the slurry sent from the dispersion tank 22 with the pure water supplied from the pure water tank 24 on one hand, and adds potassium hydroxide KOH supplied from a KOH tank 26 to the slurry on the other hand. The functions of the dispersing equipment will be described below with some specific examples.

The filtrating equipment 25 has a filter, such as a depth-type cartridge filter, depth-type bag filter, and a pleat-type filter. The filtrating equipment having a depth type filter will be described below.

The supplying equipment 32 supplies the slurry sent from the filtrating equipment 25 to a plurality (5 units in the illustrated system) of CMP polishing equipment 33*a* through 33*e*,. Here, "CMP" stands for "chemical-mechanical polishing." A slurry supplying equipment 32 will be described below with specific examples.

The polishing equipment 33*a* through 33*e* polish semiconductor devices with the slurry supplied from the supplying equipment 32. The polishing equipments 33 (33*a*–33*e*) will be described below.

The hopper 21, feeder 29 dispersion tank 22 dilution tank 23, filtrating equipment 25 and slurry supplying equipment 32 described above should preferably be applied with a lining or coating of polyurethane, Teflon, epoxy resin or the like or a ceramics lining of zirconia or the like on the inner walls, the mixing blades and other liquid and particle contacting portions to increase wear resistance to minimize metal contamination.

(2) Package

Figure 2:
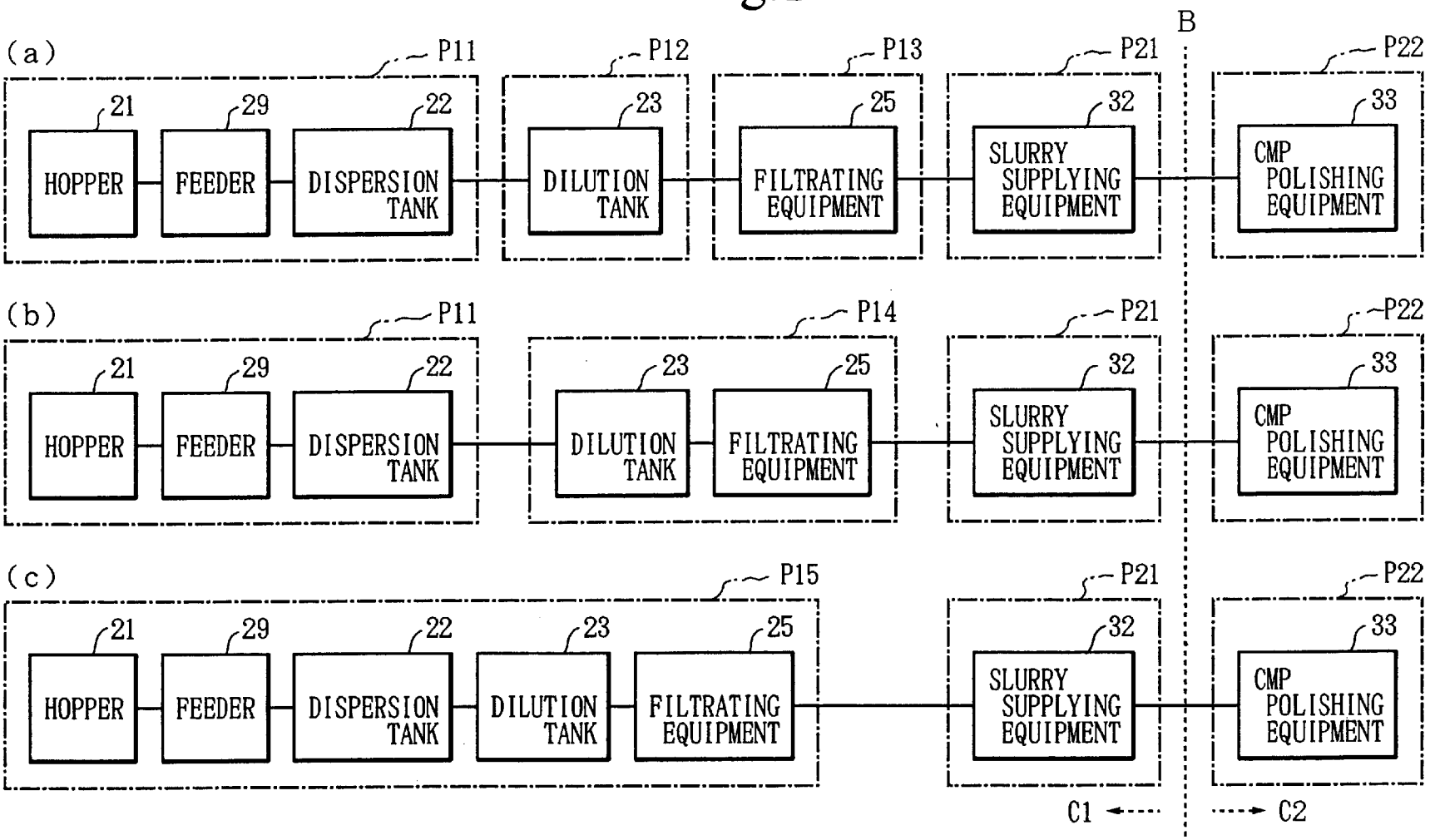
FIG. 2 is a descriptive view illustrating the combinations of equipment enclosed within the same packages when each equipment is enclosed within a package and installed within a clean room.

FIG. 2 exemplifies the combination of the dispersing equipment (hopper 21, feeder 29 dispersion tank 22, and dilution tank 23), filtrating equipment 25, supplying equipment 32 and CMP polishing equipment 33 enclosed in packages. Here, "package" is a means for sealing up the dispersing equipment, the filtrating equipment 25, the supplying equipment 32 and the CMP polishing equipment 33 to prevent the deterioration of the clean environment around equipment-installed places due to fine particles produced by the motor and other mechanical parts of the dispersing equipment, filtrating equipment 25, supplying equipment 32 and CMP polishing equipment 33 or the supplied raw material and also for exhausting the fine particles to the outside.

In FIG. 2(*a*), the hopper 21, the feeder 29 and the dispersion tank 22 are enclosed together in a package P11, the dilution tank 23 is enclosed alone in a package P12, the filtrating equipment 25 is enclosed alone in a package P13, the slurry supplying equipment 32 is enclosed alone in a package P21, and the CMP polishing equipment 33 (33*a*–33*e*) are enclosed together in a package P22.

In FIG. 2(*b*), the combination of each equipment and package is the same as that shown in FIG. 2(*a*) excepting that the dilution tank 23 and the filtrating equipment 25 are enclosed together in a package p14.

In FIG. 2(*c*), the combination of each equipment and package is the same as that shown in FIG. 2(*a*) and FIG. 2(*b*) excepting that the hopper 21 through the filtrating equipment 25 are enclosed together in a package P15.

Each of these packages is installed inside or outside a clean room. Each of these packages is equipped with an exhaust pipe (not illustrated) which is so constructed as to exhaust fine particles produced within each package to the outside of the clean room.

Each of pipes, which connect the dispersion tank 22 to dilution tank 23, the dilution tank 23 to the filtrating equipment 25, the filtrating equipment 25 to the supplying equipment 32, and the supplying equipment 32 to the CMP polishing equipment 33, is sealed.

As shown with a dotted line B in FIG. 2, it may be so arranged that, for example, each equipment from the hopper 21 to the slurry supplying equipment 32 is installed outside the clean room or within a clean room with Class C1 and the CMP polishing equipment 33*a* through 33*e* are installed within a clean room with Class C2 which is higher than the Class C1. That is, the cleanliness of the clean room in which the CMP polishing equipment 33*a* through 33*e* are installed can be increased. In this arrangement, the volume of the clean room with higher cleanliness can be reduced.

It should be noted here that the combination of equipment to be enclosed within each package should not be limited to the combinations shown in FIG. 2(*a*) through FIG. 2(*c*) but may be freely altered according to the required installation area of each equipment and other factors.

(3) Raw Materials

In the hopper 21 is supplied inorganic oxide as raw material. This inorganic oxide should preferably be in the water-laden solid state. For example, vapor-phase processed inorganic oxide in the water-laden solid state should preferably be used as raw material. Here, the inorganic oxide in the water-laden solid state, which takes the shape of particles, plates, lumps or the like, is produced by adding a specific quantity of water to inorganic oxide to increase the bulk density thereof. The addition of a specific quantity of water refers to the addition of, for example, 40 to 300 weight parts of water to 100 weight parts of vapor-phase processed inorganic oxide. By increasing the bulk density of vapor-phase processed inorganic oxide to be within 0.3 to 3 g/cm$^3$ by adding water, the vapor-phase processed inorganic oxide can be stably stored for a long time, and the production of fine particles during the handling of the vapor-phase processed inorganic oxide can be substantially reduced.

The method of obtaining the inorganic oxide in the water-laden solid state as raw material by adding water to inorganic oxide should not always limited to the above.

For example, the inorganic oxide in the water-laden solid state can be obtained by supplying little by little inorganic oxide and water into a mixing bath equipped with a mixer and slowly mixing them. If this mixing is too strong, the supplied inorganic oxide becomes not the water-laden solid state but the unfavorable slurry state. For this reason, particular care should be directed to the strength of the mixing not to be too strong. For example, when the mixing is performed by rotating a mixing blade, care should be directed to the speed of the rotation of the mixing blade. Among the granulators of mixing type for obtaining the water-laden solid matter by mixing are Flow Jet Granulator manufactured by Okawara Seisakusho Co., Ltd. and High-speed Mixing Type Mixer/Granulator Models NMG-P, NMG-H and NMG-L manufactured by Nara Macinery Co., Ltd.

Among the methods of manufacturing the water-laden solid matter of inorganic oxide without using any mixer are a method using a rolling type granulator and a method using a fluidized bed type granulator.

Figure 6A:
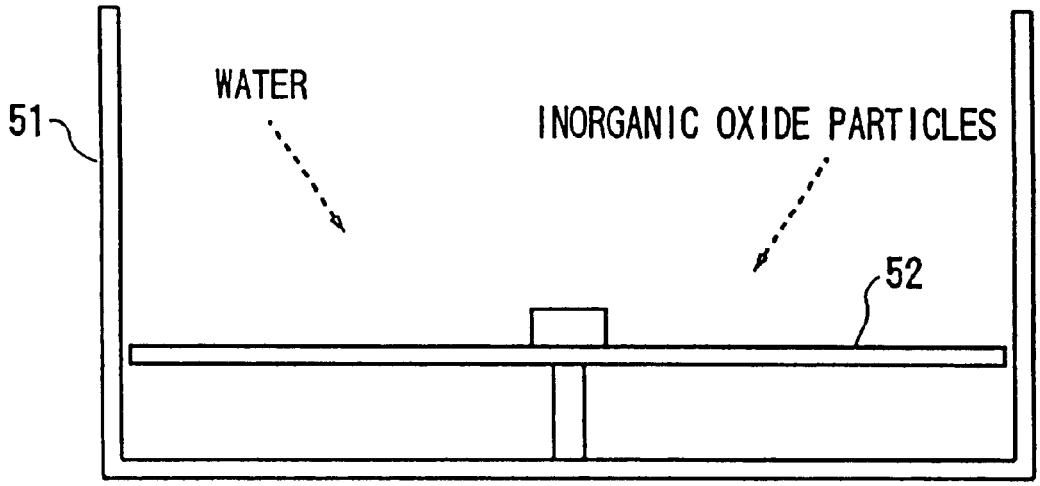
FIG. 6(*a*) is a schematic cross-sectional view of a rolling granulator viewed from the front, FIG. 6(*b*) is a descriptive view illustrating force applied to particles on a rotary disk at the inner bottom of the rolling granulator, and FIG. 6(*c*) is a descriptive view illustrating the status of rolling of particles on the rotary disk.
Figure 6B:
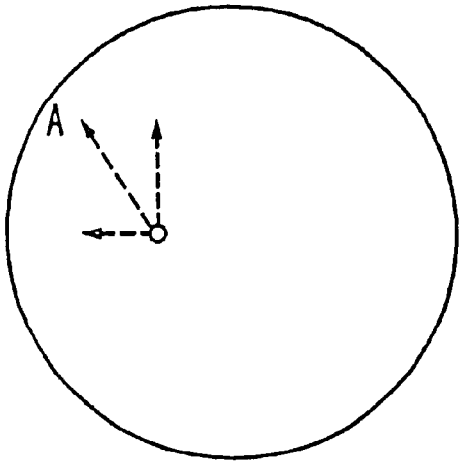
Figure 6C:
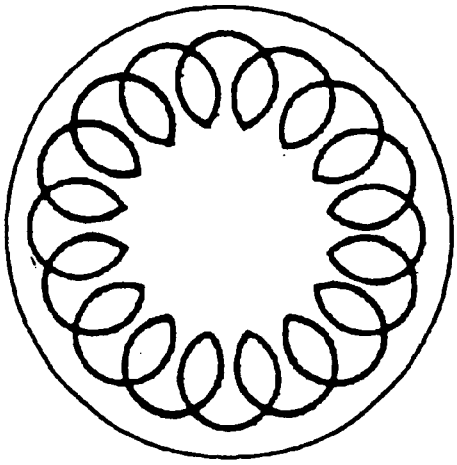

The configuration of the rolling type granulator is schematically illustrated in FIG. 6(*a*). The rolling type granulator has a rotary disk 52 at the inner bottom of a cylinder 51. This granulator granulates the inorganic oxide particles in the water-laden solid state by supplying inorganic oxide onto the rotary disk 52 while supplying water in spray or in any other form. The angle, rotational speed and depth of the rotary disk 52 are properly set, grooves are made in the top of the rotary disk 52, if necessary, and the depth, shape, direction, interval, etc. of such grooves are properly fixed. By such proper arrangement, the particles of the inorganic oxides in the water-laden solid state can become uniform in size. FIG. 6(*b*) illustrates forces applied to each particle on the rotary disk 52, and FIG. 6(*c*) illustrates the rolling status of a specific particle. To the inorganic oxide particles of irregular sizes which are granulated by being supplied onto the rotary disk 52 and supplied with water in spray are applied forces in the rotational (tangent) direction of the rotary disk 52 and forces in the centrifugal (radial) direction. By being applied these forces, each of the inorganic oxide particles in the water-laden solid state of irregular sizes repeats motions of being thrown in the direction of resultant force A, bumped against the inside wall of the cylinder 51, thrown to the inner direction, and bumped against the inside wall of the cylinder 51 again. That is, due to the rotation of each particle and the revolution of all particles in unity, each of the inorganic oxide particles in the water-laden solid state repeats eddy motions like the twisting of a rope. During these motions, each of the inorganic oxide particles in the water-laden solid state is bumped against the grooves in the rotary disk 52, thereby shocked and sheared, and gradually shaped spherical. In this way, the granular matter comparatively uniform in particle size can be obtained.

Among the rolling type granulators are Marumerizer manufactured by Fuji Paudal Co., Ltd. and Kurimoto Pan Type Granulator manufactured by Kurimoto Iron Works Co., Ltd. The rolling type granulator is available in 2 types: a type for continuously obtaining the water-laden granular matter, and a type for obtaining the water-laden granular matter in batch.

The fluidized bed type granulator continuously supplies inorganic oxide particles onto a fluidized bed formed by air blow, have the inorganic oxide particles contact with atomized minute particles of water and thereby flocculate and granulate the inorganic oxide particles in the water-laden solid state. Among the fluidized bed type granulators is Mixgrade manufactured by Okawara Seisakusho Co., Ltd. The dry process of this granulator is not used.

These equipment should preferably be provided with a lining or coating of polyurethane, Teflon, epoxy resin or the like or a ceramics lining of zirconia or the like on the liquid and particle contacting portions to minimize metal contamination, if necessary.

The above equipment can be used for obtaining granular matter as the inorganic oxide in the water-laden solid state. However, the shape of the inorganic oxide in the water-laden solid state should not be limited to be the granular matter but may be, for example, the plate matter or lump matter.

When the inorganic oxide in the water-laden solid state is manufactured into the granular matter, the average particle size thereof should be within a range of 0.5 to 100 mmϕ, preferably be within a range of 1 to 30 mmϕ, more preferably be within a range of 2 to 20 mmϕ. The bulk density thereof should be within a range of 0.3 to 3 g/cm$^3$, preferably be within a range of 0.4 to 2 g/cm$^3$, and more preferably be within a range of 0.4 to 1.5 g/cm$^3$.

As the water for use in manufacturing the inorganic oxide in the water-laden solid state, ion-exchanged water or the like having a required purity may be used.

The quantity of this water depends on the type of the inorganic oxide, the average particle size of the inorganic oxide particles, specific surface area thereof, etc. For example, the quantity of this water against 100 weight parts of the vapor-phased inorganic oxide particles should be within a range of 40 to 300 weight parts, preferably be within a range of 50 to 200 weight parts, and more preferably be within a range of 60 to 150 weight parts. If the average particle size of the inorganic oxide particles is so small that the specific surface area thereof is large, the quantity of the water should be increased. If the quantity of the water is smaller than 40 weight parts, the desired inorganic oxide in the water-laden solid state may not be obtained or even if the desired inorganic oxide in the water-laden solid state is obtained, the bulk density thereof may not be increased. Also, if the quantity of the water is smaller than 40 weight parts, a large quantity of fine particles are produced during the handling of the manufactured matter, which is not preferable considering the use before the CMP polishing equipment for semiconductor devices. On the other hand, if the quantity of the water exceeds 30 weight parts, the manufactured matter cannot become the solid state, which is not preferable, either.

If necessary and if there is no problem with any uses after manufacture, the inorganic oxide in the water-laden solid state may be added with acid or alkali.

(4) Dispersion Process and Equipment (4-1) Outline

The dispersion process for obtaining aqueous slurry by dispersing the inorganic oxide particles in an aqueous medium is performed by, for example, mixing the inorganic oxide in the water-laden solid state with the water-base medium properly added within a kneading bath of a kneader which is made to rotate by sub-spindles made to rotate by a main spindle while mixing made to rotate by the rotation of the sub-spindles. It is preferable that this kneader should be enclosed within a package so that fine particles do not float within the clean room. Here, the system of making the sub-spindles rotate by the main spindle while the mixing blades are made to rotate by the rotation of the sub-spindles is generally called "planetary system."

(4-2) Kneader of Planetary Motion Type

Figure 3A:
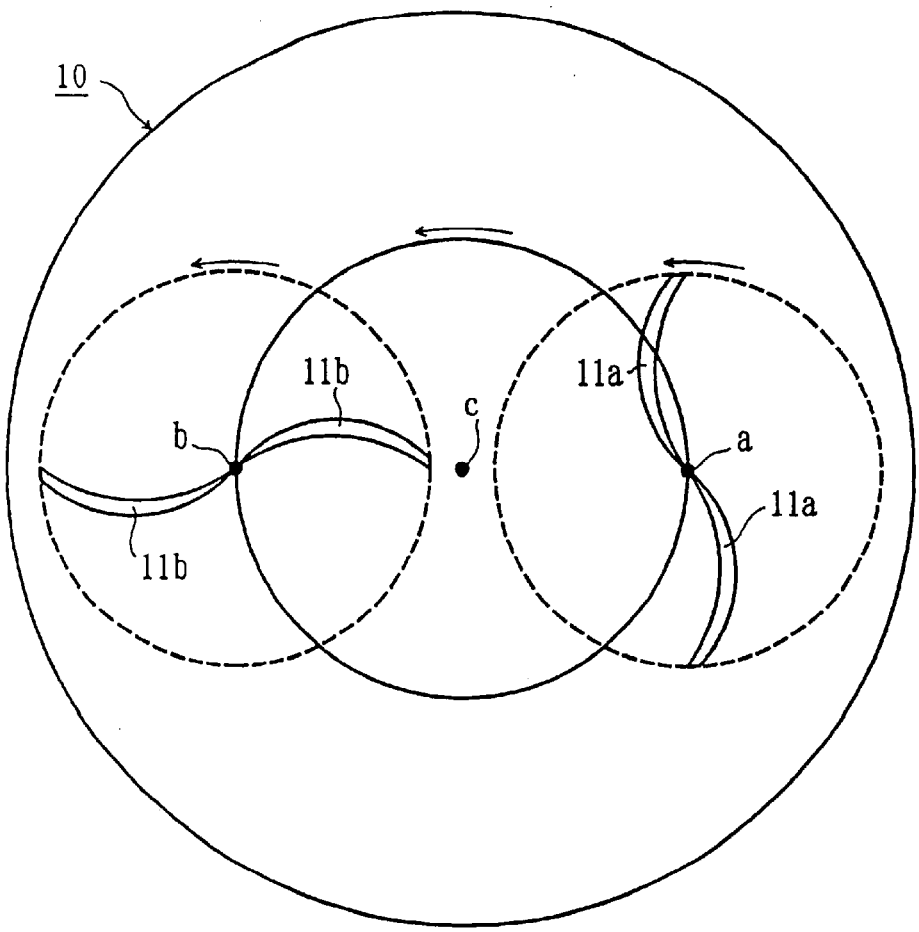
FIG. 3 is a view illustrating the principle of a planetary kneader, wherein FIG. 3(*a*) is a top view thereof, and FIG. 3(*b*) is a side view thereof.
Figure 3B:
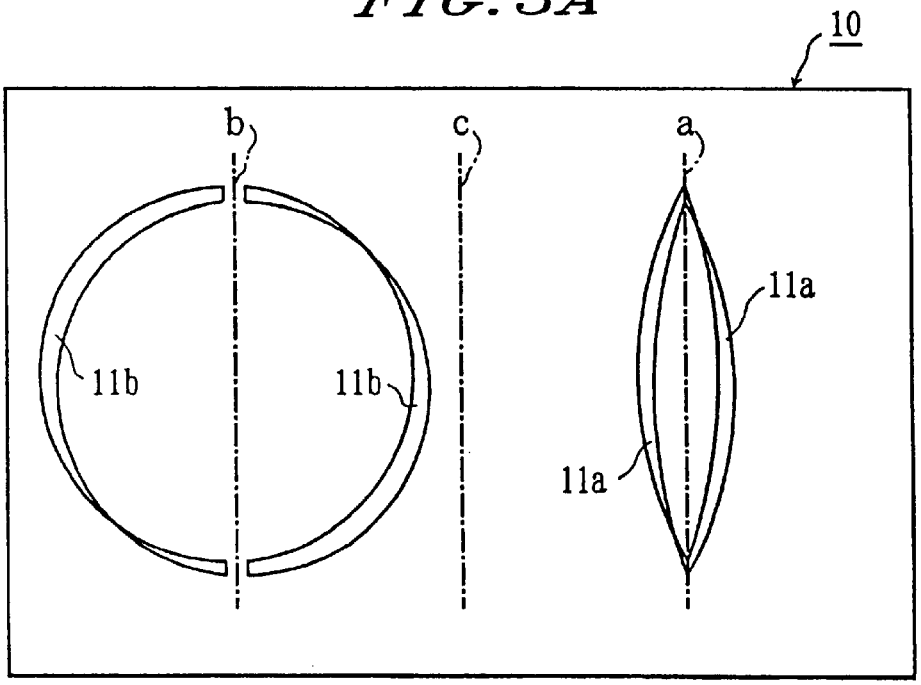

FIG. 3 schematically shows a planetary kneader, wherein FIG. 3(*a*) is a top view of such planetary kneader, and FIG. 3(*b*) is a side view thereof.

A kneader tank 10 of the kneader shown in this figure is equipped with mixing blades 11*a* which rotate around a subsidiary spindle a in a direction indicated by an arrow, mixing blades 11*b* which rotate around a subsidiary spindle b in a direction indicated by an arrow, and a spindle c which revolves to drive these 2 subsidiary spindles a and b in a direction indicated by an arrow. That is, it is so constructed that the mixing blades 11*a* and 11*b* "rotate" around the respective subsidiary spindles a and b, while the subsidiary spindles a and b "revolve" around the spindle c.

As the mixing blades 11*a* and 11*b* provided as described above move with complicated loci, the fluid within the kneading tank 10 can be uniformly kneaded and the coagula can be completely severed. As a result, a large quantity of the inorganic oxide can be efficiently dispersed in a comparatively small quantity of liquid.

In FIG. 3, 2 pieces of subsidiary spindles a and b are shown. However, it is acceptable that single piece of subsidiary spindle is provided or 3 pieces or more of subsidiary spindles are provided instead of 2 pieces of subsidiary spindles. Furthermore, when a plurality of subsidiary spindles are provided, each piece of subsidiary spindle may be positioned at regular intervals or may be provided at irregular intervals.

Also in FIG. 3, the 2 pieces of mixing blades 11*a* and 11*b* are provided as a pair on the respective subsidiary spindles a and b. However, it is acceptable that single piece of mixing blade is provided on the respective subsidiary spindles, or 3 pieces or more mixing blades are provided as a pair on the respective subsidiary spindles.

It is also acceptable that a high-speed blade is provided on a spindle coaxially with or on a spindle different from the respective subsidiary spindles of the mixing blades to improve the ability of severing and dispersing the coagula by means of such high-speed blade.

In FIG. 3, both the spindle c and the subsidiary spindles a and b rotate counterclockwise viewed from the top. However, it is acceptable that the spindle c and the subsidiary spindles a and b are set differently from each other in the rotational direction to have different loci of the motion of the mixing blades.

In FIG. 3, the mixing blades 11*a* and 11*b* are curved and twisted between the ends (i.e., in a twisted shape). However, it is acceptable that the mixing blades la and 11*b* are differently shaped in any way as long as such shape ensures that the fluid within the kneading tank can be uniformly kneaded and the coagula can be completely severed and as a result a large quantity of the inorganic oxide can be efficiently dispersed in a comparatively small quantity of liquid.

Among those planetary kneaders which satisfy the requirements described above are Universal Mixer/Stirrer (made by Dalton Co., Ltd.), Universal Mixer (made by Powlex Co., Ltd.), KPM Power Mix (made by Kurimoto Tekkojo Co., Ltd.), Planetary Kneader/Mixer (made by Ashizawa Co., Ltd.), T.K. Hibis Disper Mix (Tokushu Kika Kogyo Co., Ltd.), and Planetary Disper (Asada Iron Works Co., Ltd.), which can be preferably used. Particularly, Planetary Disper and T.K. Hibis Disper Mix, both of which combine mixing blades and a high-speed blade (disper), are preferable for their ability to uniformly disperse a large quantity of the inorganic oxide in a comparatively small quantity of liquid in a short time.

The aqueous slurry may be subjected after dispersion to further dispersion processing in another kneader or disperser to increase the uniformity. In this case, for example, a corres-type high-speed mixer/disperser, a homo-mixer, a high-pressure homogenizer or a bead mill may preferably be used.

(4-3) Concentration in the Dispersion Process

In the above dispersion process,the concentration of the inorganic particles in an aqueous slurry should be 30–70 wt %, preferably be 35–60 wt %, and more preferably be 40–50 wt %. If the concentration of the inorganic particles is less than 30 wt %, the dispersion efficiency drops to such an extent that a large quantity of coagula may be left in the obtained aqueous slurry, and as a result, such coagula may sediment and separate during storage or gel due to viscous increase. On the other hand, if the concentration of the inorganic particles exceeds 70 wt %, load on the disperser becomes too large to maintain mixing in motion. If mixing is forced in such state, the inorganic particles are excessively dispersed, and as a result, a large quantity of coarse particles having a particle diameter of 10 $\mu$m or more may be produced due to re-coagulation.

(4-4) How to Add Inorganic Oxide

When manufacturing the slurry, it is preferable that the inorganic oxide should be mixed with water while it is continuously or intermittently added. If a necessary quantity of the inorganic oxide is added at a time in the first place, there would be a problem that the load on the mixer is so large that the mixer would stop. Therefore, it is preferable that the inorganic oxide is continuously or intermittently added while monitoring the current value of (load on) the kneader so that the load cannot become too much. Among an equipment for supplying inorganic oxide is one which make use of natural fall and one which feeds the inorganic oxide by means of, for example, screw.

Using the inorganic oxide not in the powder state but in the water-laden solid state is extremely preferable for the manufacturers who manufacture and polish semiconductor devices and think that the clean environment is extremely important as there is no production of fine particles compared to a case where the inorganic oxide in the powder state is used. Furthermore, when the inorganic oxide in the water-laden solid state is used, it is possible to shorten the time required for adding the inorganic oxide and substantially improve the operation efficiency of the equipment.

(4-5) Addition of Alkali or Acid

Adding an acid or alkali to the above aqueous slurry is preferable as the stability of the finally obtained aqueous slurry of inorganic particles is improved. When an acid is added, it is preferable that the pH of the aqueous slurry of inorganic particles obtained after the final dilution should be in a range of 7–2. When an alkali is added, it is preferable that the pH of the aqueous slurry of inorganic particles obtained after the final dilution should preferably be in a range of 7–12. If the pH is smaller than 2 or larger than 12, the inorganic particles may be dissolved or coagulated.

An acid or an alkali may be added to the aqueous slurry in any timing. It may be added to the aqueous medium beforehand, during the addition of inorganic oxide, after the addition of inorganic oxide, during kneading or after kneading. Preferably, it should be added during kneading or before dilution after kneading (The dilution will be described later.). When it is added during kneading or before dilution after kneading, the coagulation in the aqueous slurry due to the addition of an acid or alkali can be prevented.

As an acid, inorganic acids, such as hydrochloric acid, nitric acid, sulfuric acid and phosphoric acid, or organic acids, such as acetic acid, phthalic acid, acrylic acid, methacrylic acid, crotonic acid, polyacrylic acid, maleic acid and sorbic acid, may be used. Among of these, hydrochloric acid, nitric acid and acetic acid, which are univalent acids, are preferable.

As an alkali, inorganic bases, such as potassium hydroxide, sodium hydroxide, lithium hydroxide and ammonia, and amines, such as ethylenediamine, trirthylamine and piperazine, may be used.

If necessary, 1 or more chemical agents such as oxidant, chelating agent, pH regulator or the like may be supplied to slurry supplying equipment 32 to be mixed with the slurry.

(4-6) Dilution

The slurry obtained as described above is diluted, if necessary, after the kneading process. According to the system shown in FIG. 1, the dilution is performed within the dilution tank 23 into which potassium hydroxide KOH is supplied from the KOH tank 26 and pure water is supplied from the pure water tank 24. When the dispersion is performed by using the planetary kneader, the extent of the dilution depends on the type of the dispersed inorganic oxide particles or the concentration during the kneading. However, it is preferable that the concentration should be lowered by 5 wt % or more from the concentration during the kneading by the dilution with a water-base medium. If the concentration during the kneading process is not lowered, not only it is difficult to handle the slurry due to high viscosity but also it is troublesome due to further increase in viscosity and gelation.

(4-7) Other Equipment Used in the Dispersion Process

In addition to the planetary kneader described above, high-pressure homogenizer, for example, which bumps fluid to disperse the inorganic oxide particles, can be used as the dispersion tank 22. Among the high-pressure homogenizers are Mantongaurin Homogenizer supplied from Doei Shoji Co., Ltd., Verori Homogenizer manufactured by Nihonseiki Kaisha Ltd., Microfluidizer manufactured by Mizuho Industrial Co., Ltd., Nanomizer manufactured by Tsukishima Machinery Co., Ltd., Genus PY manufactured by Hakusui Chemical Industries Co., Ltd., System Organizer supplied from Japan B.E.E. Co., Ltd., and Ultimaizer from Itochu Sanki Co., Ltd. Dispersers, such as Beads Mill, may also be used. Among the preferable materials of beads are non-alkali glass, alumina, zircon, zirconia, titania and silicon nitride.

(5) Filtration Process and Equipment (5-1) Depth Type Filter In order to sufficiently remove coarse particles from the aqueous slurry for polishing which is obtained by dispersing the inorganic oxide particles with water as described above, the slurry is then filtrated through a filter. The filter to be used is not limited to a specific type. For example, depth type filter, pleat type filter and so on may be used. The system shown in FIG. 1 has a depth type filtrating equipment 25 which has a depth type cartridge filter and is provided behind the dilution tank 23(=an element of dispersing equipment) in connection thereto. Among the depth type cartridge filters are filters supplied from Advantech Toyo Co., Ltd. and Japan Pall Co., Ltd. It is also possible to provide a filtrating equipment using a bag type filter behind the dispersing equipment in connection thereto. Among the bag type filters is a filter supplied from ISP Co., Ltd.

The depth type filer is an integrated filter in which pores in the filter material are coarse on the inlet side and fine on the outlet side and steplessly or stepwisely become finer from the inlet side toward the outlet side. As the filter material of the depth type filter is sufficiently thick (e.g., 0.2 to 2 cm), the depth type filter can collect a large quantity of foreign matter from the fluid flowing through the filter material.

Figure 4A:
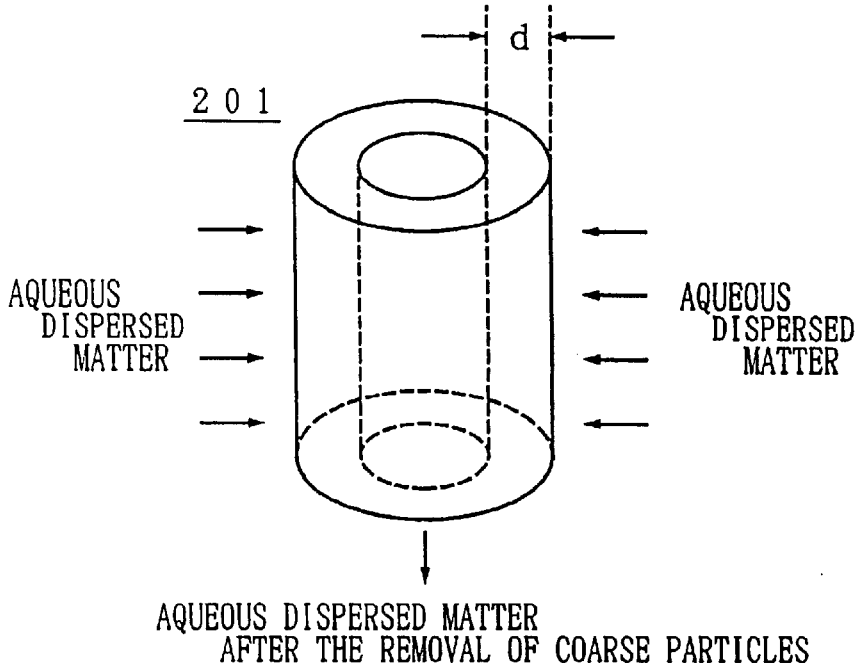
FIG. 4(*a*) is a perspective view schematically illustrating a depth type cartridge filter of hollow cylindrical shape, and FIG. 4(*b*) is a schematic view illustrating pore structure in the thickness direction and fiber diameter of the depth type filter.
Figure 4B:
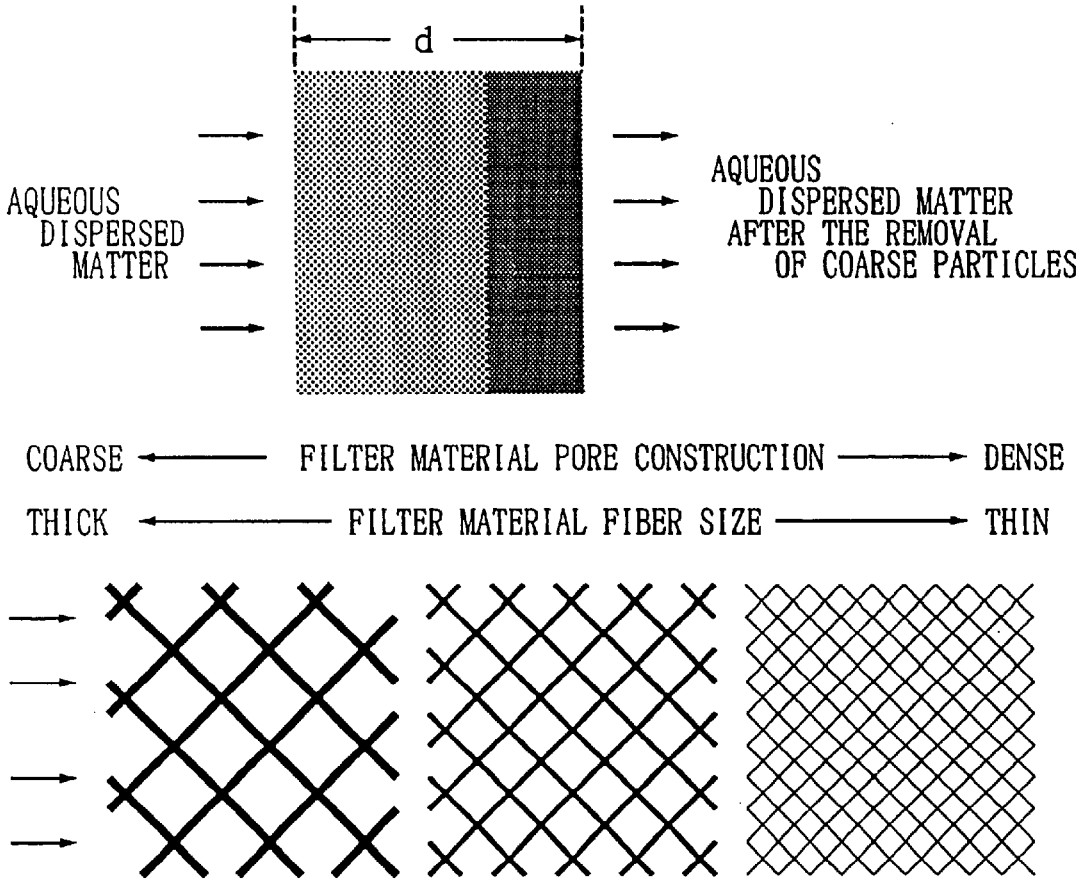

For example, as shown in FIG. 4(*b*), the depth type filter is a filter material having a thickness of d and so designed that the pore structure is coarse on the entry (inlet) side of the fluid and fine on the discharge (outlet) side thereof and becomes finer from the entry side toward the discharge side with or without steps (for becoming finer with steps, the number of steps may be 1 or more). Owing to this pore structure, among all the coarse particles, comparatively large particles are removed near the entry side, and comparatively small particles are removed near the discharge side. As a whole, coarse particles are removed throughout the filter in the direction of thickness (in the passing direction of the fluid). As a result, coarse particles can be exactly removed, and at the same time, the filter is not clogged with particles so easily and therefore can extend its service life.

Also, as shown in FIG. 4(*b*), the depth type filter uses a filter material which is so designed that the fiber is thick on the entry (inlet) side of the fluid and thin on the discharge (outlet) side. Owing to this fiber arrangement, the void is almost uniform at each portion of the filter material from the entry side of the fluid to the discharge side thereof. Here, the void is a percentage of gap per unit cross-sectional area within a plane which crosses at right angles the passing direction of the fluid. As the void is almost uniform as described above, pressure loss caused when the fluid is passing through the filter is small, and the removing conditions of coarse particles are almost uniform in the passing direction of the fluid. Furthermore, a pump of comparatively low pressure specifications can be used.

Figure 5A:
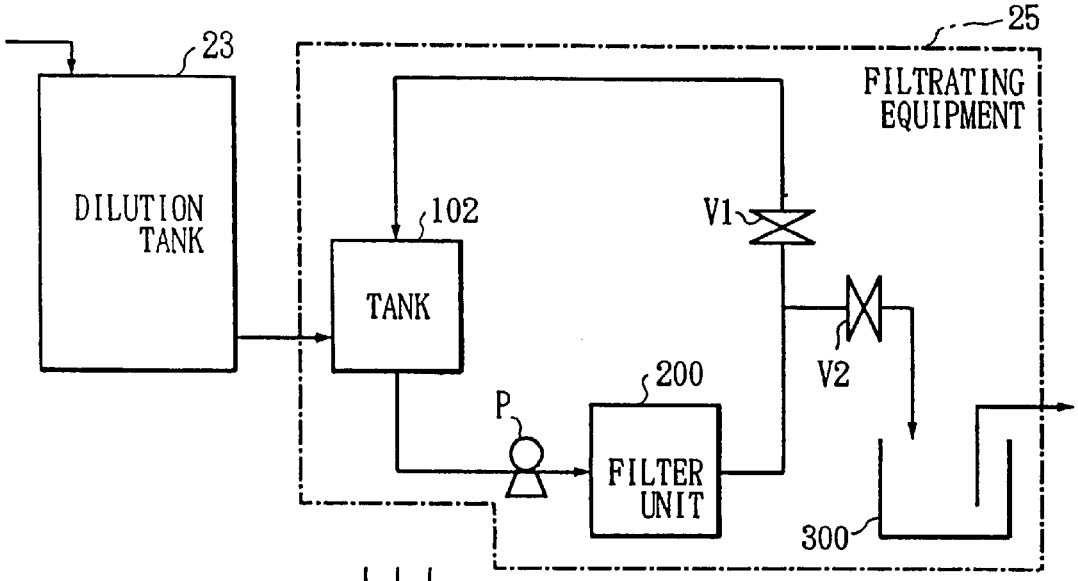
FIG. 5(*a*) is a descriptive view illustrating an example of a filtration system using the depth type filter of FIG. 4, and FIG. 5(*b*) is a perspective view schematically illustrating the depth type filter of bag shape.
Figure 5B:
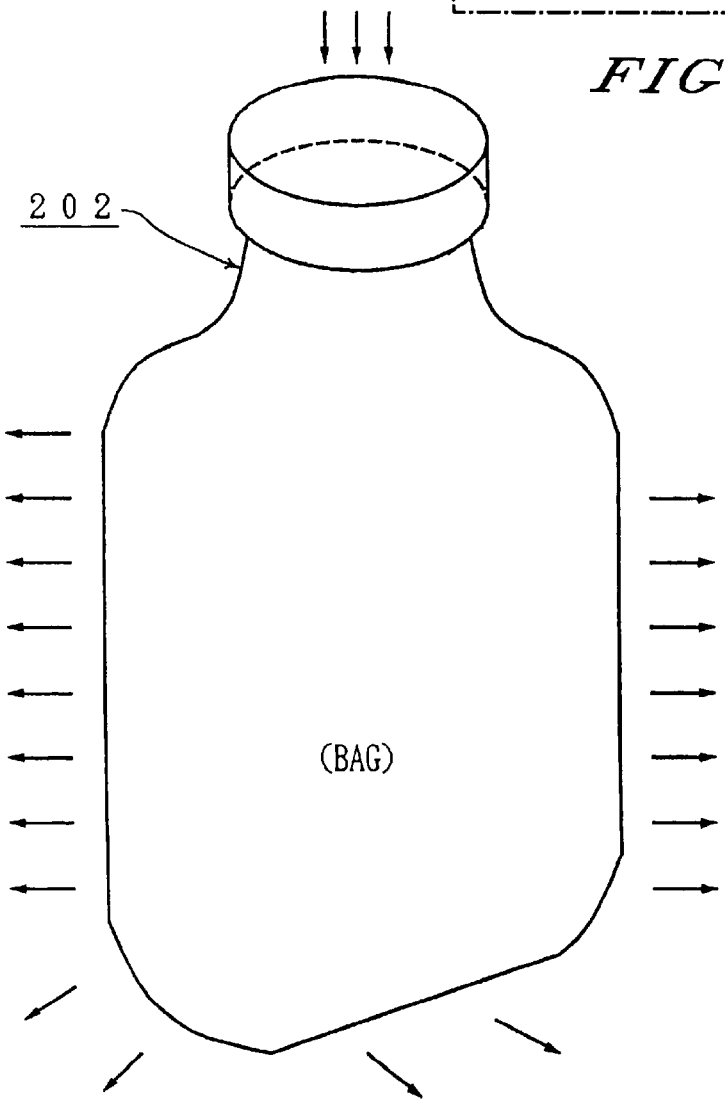

The depth type filter may be a cylindrical filter 201 of cartridge type as shown in FIG. 4(*a*) or a filter 202 of bag type as shown in FIG. 5(*b*). The cylindrical filter 201 is advantageous in that the thickness of the filter material can be designed to the desired thickness. On the other hand, the bag type filter 202 has an effect that as it can be provided within a filter unit 200 (FIG. 5(*a*)) so that the fluid can pass through from the inside of the bag to the outside thereof, the removed particles can be disposed of together with the bag type filter 202 when the latter is replaced.

When a filter, such as depth type filter, is set within the filter unit 200 shown in FIG. 5(*a*), it is possible to remove coarse particles from the aqueous slurry in which inorganic oxide were added to and dispersed in an aqueous medium.

Incidentally, by selecting the pore structure of the filter, the particle diameter of the coarse particles to be removed can be controlled accordingly.

(5-2) Filtrating Equipment

FIG. 5(*a*) shows a system configuration of the filtrating equipment usable as the filtrating equipment 25 of FIG. 1. According to the system shown in FIG. 5(*a*), the slurry send from the dilution tank 23 is stored within a tank 102, then forcedly sent from the tank 102 to the filter unit 200 by using a pump P, then filtrated through the filter 201 (or 202) set within the filter unit 200, then returned through a valve V1 to the tank 102. By repeating this cycle, coarse particles within the slurry are sufficiently removed, then the valve VI is closed and a valve V2 is opened, and the slurry after the coarse particles are removed is stored within a tank 300. It is preferable that this filtrating equipment should be enclosed within a package so that fine particles do not float within the clean room. FIG. 5(*a*) shows a circulation type system. However, single pass type system may be used. That is, this system may be such that the slurry within the tank 102 is filtrated through the filter unit 200 and send via the valve V2 to the tank 300. In case of the single pass type, the tank may be pressurized by applying air pressure or the like for filtration instead of using the pressure pump P.

Moreover, a centrifugal separation method may also be used in combination. Where this method is used in combination, the filter is not clogged with particles so easily and therefore can extend its service life. In addition, when a filter of large pore structure is used in combination in the upstream, the depth type filter can be protected better from clogging, and extend its service life.

(6) Supply Process and Equipment

The slurry supplying equipment 32 used in the supply process supplies the slurry of inorganic particles sent from the filtrating equipment 25 to the CMP polishing equipment 33*a* through 33*e* located therebehind. It is desirable that there should be no mixing of impurities into the slurry in this equipment and there should be no flocculation of inorganic particles within this equipment. For this reason, it is preferable that the lining or coating described above (a lining or coating of polyurethane, Teflon, epoxy resin or the like or a ceramics lining of zirconia or the like) should be provided to the liquid contacting portions. It is also preferable that a mixing means (e.g., propeller) should be provided to prevent the flocculation of inorganic particles due to the occurrence of stagnation. It is still preferable that the supplying equipment 32 should be enclosed within a package so that fine particles do not float within the clean room. It is still preferable that the slurry supplying equipment 32 should be provided with a means for detecting the concentration of the slurry within this equipment.

(7) Maximum Supply Rate Per Unit Time and Dispersion/Filtration Capacity

The dispersion capacity per unit time of the dispersing equipment 22 and the filtration capacity per unit time of the filtrating equipment 25 of the system according to the present embodiment are specified based on the maximum value of fluctuating supply rate per unit time of the aqueous slurry of inorganic particles supplied from the slurry supplying equipment 32 to the polishing equipment 33*a* through 33*e*, i.e., the maximum value of fluctuating consumption rate per unit time of the slurry for polishing required for the polishing process by the CMP polishing equipment 33*a* through 33*a*. Specifically, the size of the dispersing equipment (the volume of the dispersion tank 22) and the capacity of the filtrating equipment 25 are specified. The maximum value of fluctuating consumption rate of the slurry for polishing is, for example 5 L/min or so. The volume of the dispersion tank 22 for the above maximum consumption rate is 50 L or so, though it depends on the type of the raw material. In this case, the size of the filter is equivalent to one piece of 2.5-inchϕ×20-inch cartridge or so.

(8) Detection of Polished Condition and Feedback

The CMP polishing equipment 33*a*–33*e* polish (smoothen) the surface of semiconductor device to be polished to the desired smoothness by using the slurry for polishing. The system according to the present embodiment has a means for detecting the polished condition (not illustrated) on the polishing equipment 33. By using this detecting means, it is possible to achieve the optimum polishing by monitoring the polished condition of semiconductor devices and adjust the raw material, adjust the dispersion process, adjust the extent of the dilution, adjust the filtrating process or adjust the mixing by the slurry supplying equipment.

(9) Analyzing Equipment

Each of the equipment placed in the manufacturing system for manufacturing the CMP slurry according to the present embodiment may have an analyzing equipment. Among the analyzing equipment to be provided in the dispersing equipment, the filtrating equipment 25 and/or the supplying equipment 32 are measuring equipment for temperature, measuring equipment for pH, measuring equipment for density, measuring equipment for viscosity, measuring equipment for particle size and measuring equipment for number of coarse particles. By installing a singularity or plurality of these measuring equipment, it is possible to manufacture precisely controlled slurry and supply the same to the CMP polishing equipment 33.

PARTS LIST

21 hopper
22 dispersion tank
23 dilution tank
24 filtrating equipment
25 slurry supplying equipment
33*a*–33*e* CMP polishing equipment

We claim:

1. A manufacturing system for semiconductor devices, comprising:

a dispersing equipment for dispersing inorganic oxide in water to obtain slurry by kneading the inorganic oxide with the water;

a filtrating equipment provided behind the dispersing equipment in collection thereto for filtrating the slurry sent from the dispersing equipment;

a supplying equipment provided behind the filtrating equipment in connection thereto for supplying the slurry sent from the filtrating equipment;

a polishing equipment provided behind the supplying equipment in connection thereto for polishing semiconductor devices by using the slurry supplied from the supplying equipment;

the dispersing equipment, the filtrating equipment, the supplying equipment, and the polishing equipment being enclosed in packages, each of which has exhausting means, respectively; and connecting means for connecting the dispersing equipment to the filtrating equipment, the filtrating equipment to the supplying equipment, and the supplying equipment to the polishing equipment being sealed respectively.

2. A manufacturing system according to claim 1, wherein a dispersion capacity per unit time of the dispersing equipment and a filtration capacity per unit time of the filtrating equipment are specified based on a maximum value of fluctuating consumption rate per unit time of slurry in the polishing equipment.

3. A manufacturing system according to claim 1, wherein the dispersing equipment adjusts the dispersion process based on the polish-condition of polished semiconductor devices.

4. A manufacturing system according to claim 1, wherein the inorganic oxide being dispersed in water is vapor-phase processed inorganic oxide in the water-laden solid state.

* * * * *